US005628694A

United States Patent [19]

O'Connor, Jr.

[11] Patent Number: 5,628,694

[45] Date of Patent: May 13, 1997

[54] TRAINING PUTTER AND RUG

[76] Inventor: Frederick J. O'Connor, Jr., Box 638, Cuttingsville, Vt. 05738

[21] Appl. No.: 667,625

[22] Filed: Jun. 21, 1996

[51] Int. Cl.[6] ..... A63B 69/36

[52] U.S. Cl. ..... 473/157; 473/250; 473/253

[58] Field of Search ..... 473/157, 238, 473/242, 243, 244, 245, 246, 247, 248, 249, 250, 251, 252, 253

[56] References Cited

U.S. PATENT DOCUMENTS

| | | | |
|---|---|---|---|
| D. 229,622 | 12/1973 | Bartron | 473/253 X |
| 3,866,922 | 2/1975 | Marci et al. | 473/250 |
| 4,222,566 | 9/1980 | Berry | 473/250 |
| 4,390,184 | 6/1983 | Rudell | 473/253 |
| 4,826,174 | 5/1989 | Hoyt | 473/157 |
| 5,409,231 | 4/1995 | Kueng et al. | 473/157 |

*Primary Examiner*—George J. Marlo
*Attorney, Agent, or Firm*—John J. Welch, Jr., Esq.

[57] ABSTRACT

A Training Putter and Rug consisting of tugging with two short lines drawn on the top surface of and near one end of the rugging parallel with the long central axis of symmetry of the rug and one center line co-extensive with the central axis equidistant from and between each of the two short lines which center line extends to a point in a circle drawn near the other end of the rugging and a putter with a bowed shaft affixed to a rectangularly shaped putter head, hollow in the center with three thin bars at the base of the hollowed center that are parallel with and co-extensive with the three lines on the rugging when the putter is placed flat on the rugging during proper use of the device and with two identical milled lateral faces on the putter head and two identical etched lines that are co-extensive with the middle one of the three bars and which are found one each on the topsides of the lateral portions of the putter head.

7 Claims, 4 Drawing Sheets

TRAINING PUTTER AND RUG

BACKGROUND OF THE INVENTION

1. Field of the Invention

Figure 1:
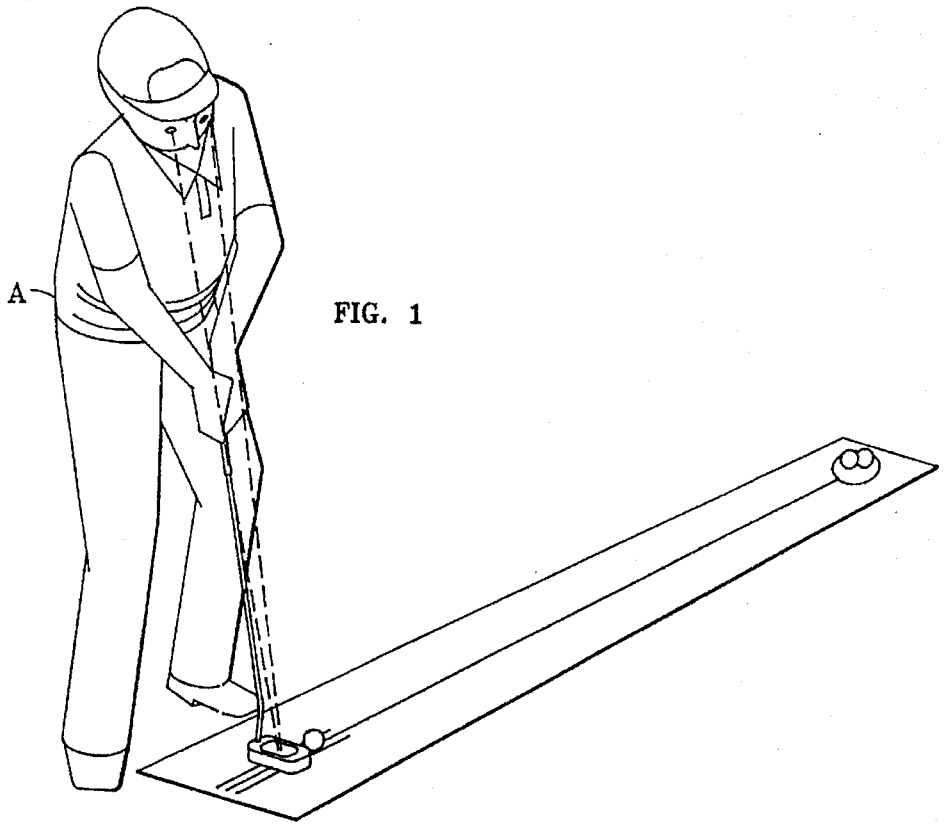

The instant invention is one of those various items of sporting goods, in particular practice aid gold clubs serving to facilitate muscle memory in respect of, in the present instance, the art of putting golf balls.

2. Possible Prior Art

The following references set forth devices that may resemble but which are significantly different from the instant invention:

| Inventor | Invention | Patent No. | Date |
|---|---|---|---|
| Cook, Raymon W. | Golf Putter Head | D 236,517 | 08/26/75 |
| Worrell | Golf Practice Apparatus | 3,649,029 | 03/14/72 |
| Rydeck | Golf Club Swinging Training Device | 4,355,810 | 10/26/82 |
| Wilson | Alignment System for Golf Ball Driving and Hitting Matt | 5,333,875 | 08/02/94 |
| Whitfield | Putter | 4,805,922 | 02/21/89 |
| Sheltman et al. | Device For Putting Training | 5,246,233 | 09/21/93 |
| Artola | Putter with Guide Finn or Mark | 5,441,272 | 08/15/95 |
| J. M. Self | Golf Putting Aid | 2,858,133 | 10/28/58 |
| Burke | Bulge Putter | 5,333,873 | 08/02/94 |
| Sharp | Golf Putter with Alignment Means | 5,052690 | 10/01/91 |
| Green | Golf Putter with a Corian | 5,324,031 | 06/28/94 |
| Cannon | Putterhead Apparatus and Method of Manufacture Golf Putter | 5,273,282 | 12/28/93 |

A SUMMARY OF THE INVENTION

1. A Brief Description of the Invention

The instant invention is a training aid serving to assist golfers in their efforts to better master the art of putting. One component of the invention is a foldable rug that has light colored markings on its top side. The markings in the vicinity of one end of the rug consist of three parallel lines. The two outside lines are equidistant from the centerline which is co-extensive with the long central axis of symmetry of the rug. The two outside lines are much shorter than the center line which center line runs virtually the length of the rug and ends up touching a circle marked on the rug's top side in the vicinity of the other end of the rug. The center of the circle lies on what would be an extension of the light colored center line on the top surface of the rug which is itself typically dark colored, i.e., dark green. The marked circle functions as an artificial golf cup etched on the rug, an artificial golf green. The second component, a putter component consists of a shaft affixed to the top of a hollowed out putter head. The putter head is rectangular in shape with depth and a hollow rectangularly shaped center hole. At the base of the center hole are each of three thin bars extending from the inner aspect of one side of the putter head to the inner aspect of the other side. The shaft is bowed at near where it is affixed to the top of the putter head. An imaginary extension of the shaft from just above where it begins to bow, if visualized in a golfer's mind's eye when the golfer rests the putter head flat on the top side of the rug during proper use thereof such that the three bars at the base of the putter head cover exactly the three lines earmarked on the top side of the rug; will be seen to pass through the center point of the middle one of the three bars. Also, on the topside of each lateral section of the putter head are two etched co-planar lines with, each one parallel with and co-extensive with the lie of the middle one of the three bars. Also, each lateral center face of the putter head is milled to a roughened texture so as to render each center face amenable to appropriately gripping into the dimples of a golf ball on the top side of the rug just in front of the putter. Moreover, in view of the symmetry and identity of shape of each such face, the putter component can be utilized by either a left handed or right handed. A golfer utilizing the invention lines up a practice putt as noted above, brings the putter back in such a manner that the bars always cover the lines below the bars, then brings it forward into the ball with the bars still covering the lines and after impacting the ball follows through with the bars still covering the lines. Repetition of the foregoing stroking technique promotes muscle memory regarding the optimally proper way to stroke a putter on a natural golf green where the putter component alone can be utilized in putting while utilizing the above-mentioned two etched lines as directional aides.

2. Object of the Invention

It is often said that putting is a game within the game of golf. A putter is a golfer's most important club. Parwise, a golfer should have taken 36 of his or her total strokes in an 18 hole round of golf with a putter on the greens. However, far too often, a golfer's score rises undesireably due to 3-putt holes, missed short putts, etc. Many more times than not extra putts result from a putting club turning in a golfer's hands on the backstroke or backstroking inside or outside of the extension of the line between the ball and the cup on a golf green. Such erratic putting is ultimately due to a lack of muscle memory on the part of the golfer. Accordingly, it is an object of the instant invention to facilitate muscle memory for a golfer such that after multiple repetitions properly utilizing the invention, the golfer on a golf green will instinctively stroke his or her putts true with minimal to no erratic backswinging or throughswinging.

Respectfully submitted, by virtue of the instant invention's facility for being able to markedly promote the muscle memory needed for repeatedly true putts always on one's pre-prescribed line, it is a truly new, useful and unique device to the extent that it is virtually revolutionary in the art of manufactured golf and putting aids.

A DESCRIPTION OF THE DRAWINGS

1. FIG. 1 schematically shows the instant invention in use by a golfer.

Figure 2:
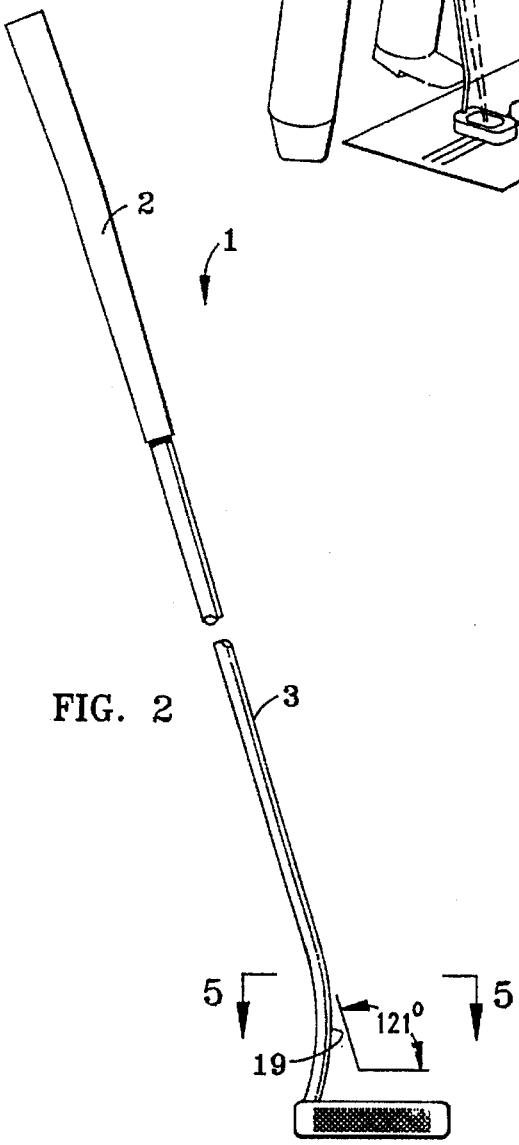

2. FIG. 2 is a lateral view of the putter component of the instant invention.

Figure 3:
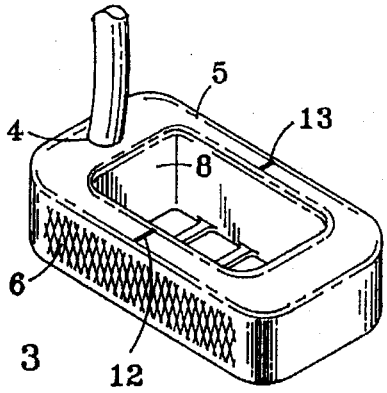

3. FIG. 3 is a perspective view of the putter component's putter head.

Figure 4:
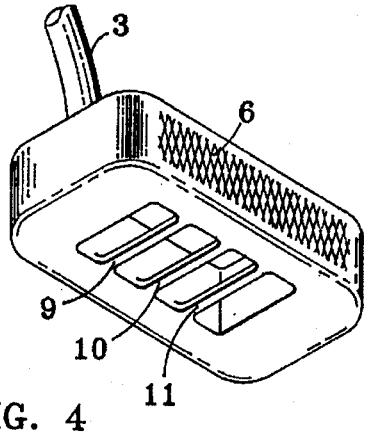

4. FIG. 4 is a perspective view, in particular, of the bottom of the putter component's putter head.

Figure 5:
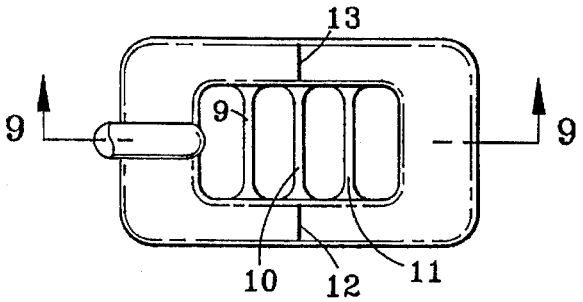

5. FIG. 5 is a top plan view of the putter component's putter head.

Figure 6:
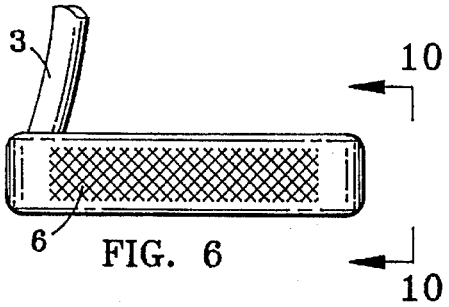

6. FIG. 6 is a first lateral plan view of the putter component's putter head.

Figure 7:
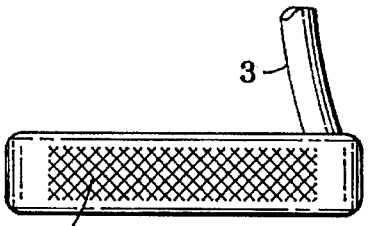

7. FIG. 7 is a second lateral plan view of the putter component's putter head.

Figure 8:
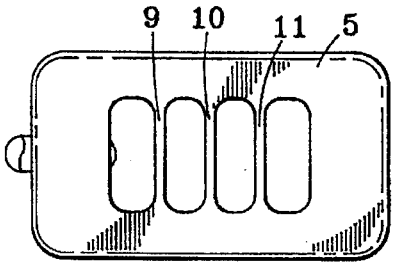

8. FIG. 8 is a bottom plan view of the putter component's putter head.

Figure 9:
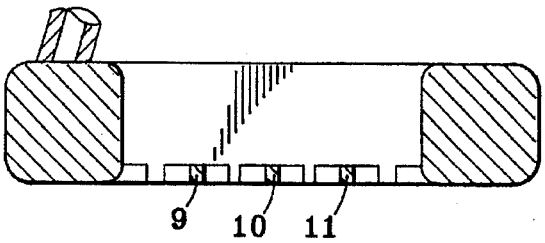

9. FIG. 9 is a lateral cross-sectional view of the putter component's putter head.

Figure 10:
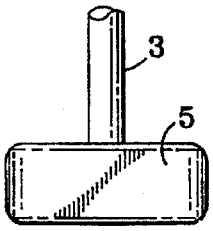

10. FIG. 10 is a front plan view of the putter component's putter head.

Figure 11:
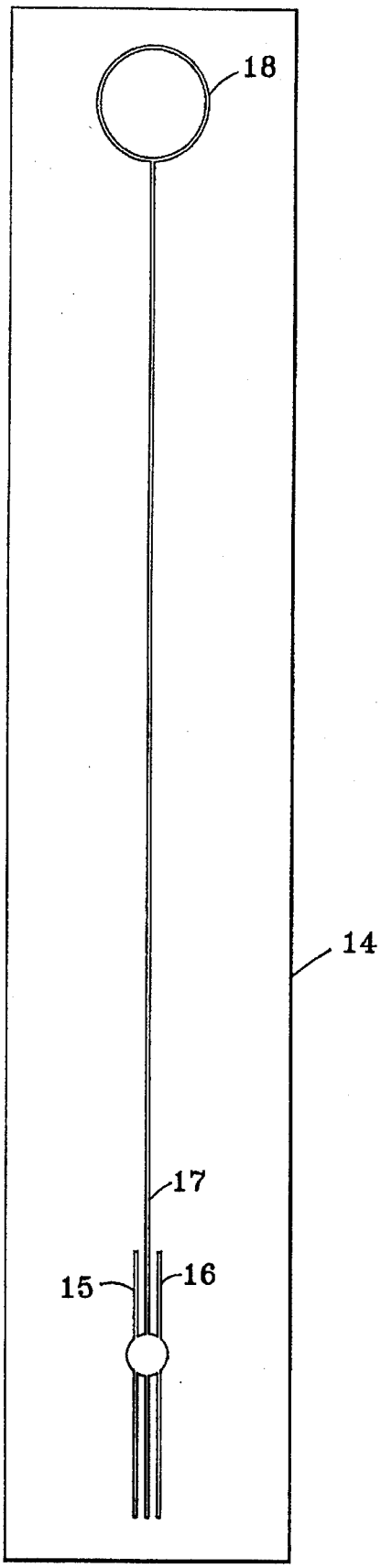

11. FIG. 11 is a top plan view of the rug component of the instant invention.

Figure 12:
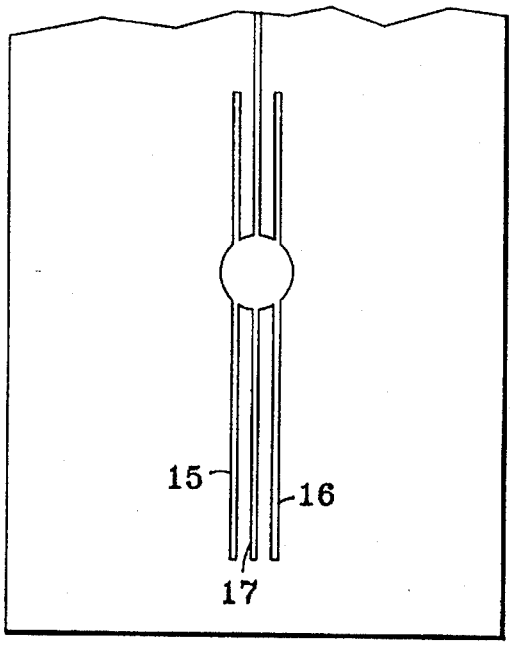

12. FIG. 12 is a cutaway close up top view of one end of the top side of the rug component of the instant invention.

Figure 13:
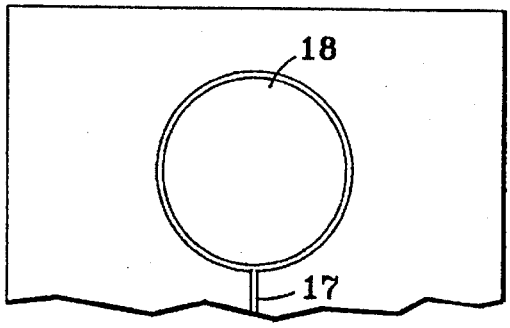

13. FIG. 13 is a cutaway close up top view of the other end of the top side of the rug component of the instant invention.

Figure 14:
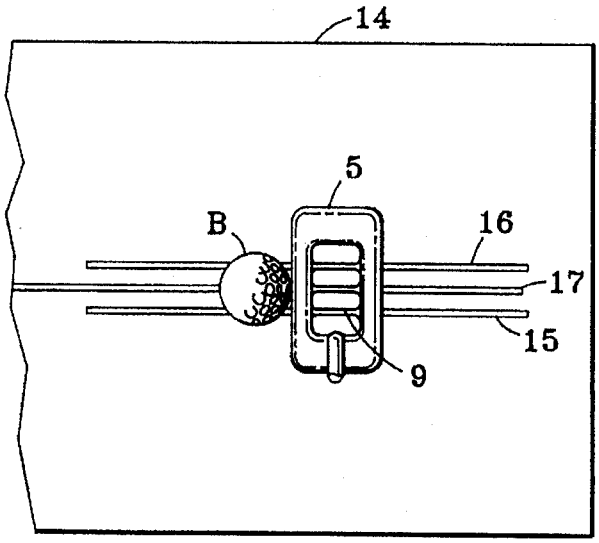

14. FIG. 14 is a top view of the soles of a golfer's feet in apposition to the rug with, the putter head flat, bars over lines, on the rug as the shaft is properly held with a golf ball in apposition to the putter head.

Figure 15:
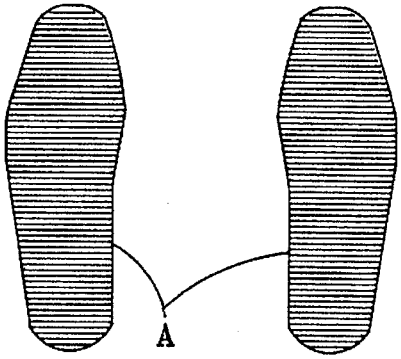
Figure 15:
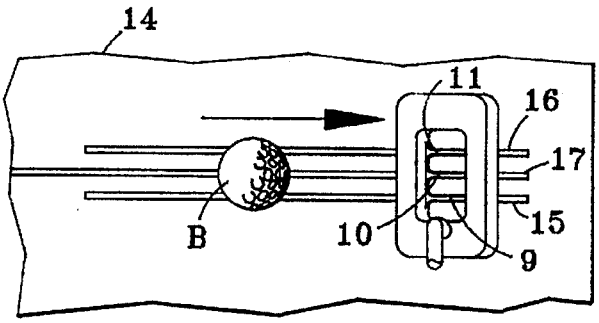

15. FIG. 15 evidences a proper putting backstroke, bars over lines.

Figure 16:
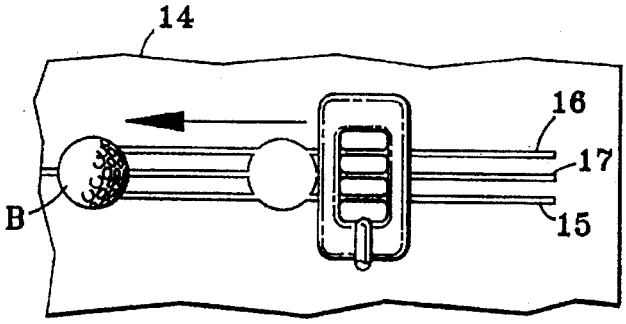

16. FIG. 16 evidences a proper following through, bars over lines.

A DESCRIPTION OF THE PREFERRED EMBODIMENT

The instant invention consists of two components, namely, a putter component and a rug component. FIG. 1 illustrates use of the invention by Golfer A. FIG. 2 depicts shaft grip 2 affixed to shaft 3 of the invention's putter component 1. FIG. 3 shows putter head 5 and shaft insertion 4 of component 1. Putter head 5 is rectangular in shape and is further characterized by the presence of a rectangularly shaped center hole 8. Each lateral side of the putter head 5 is characterized by the presence of a milled face. A first milled face 6 as seen in FIG. 3 on one lateral side of putter head 5 characterized by a slightly raised and roughened, as opposed to smooth, hue serves to facilitate true and firm contact between face 6 and a golf ball B being putted by way of serving as a unique means of acceptance of the dimples on the outside surface of the ball. A second milled face 7 on the other lateral side of putter head 5 as seen in FIG. 7 equivalent to milled face 6 serves the same function. The shape of putter head 5 as well as the synonymous natures of milled faces 6 and 7 seen in FIGS. 6 and 7 respectively enable the putter component of the instant invention to be utilized by either a left handed golfer or a fight handed golfer. FIGS. 4, 5 and 8 serve to highlight the presence of the three basebars found at the bottom of centerhole 8. There is a first basebar 9, a second basebar 11 and a center base bar 10. Each basebar is co-planar with and parallel with the other. FIG. 9, a cross-sectional view serves to demonstrate how putter head 5 is constructed with reference, for example, to the location thereupon of bars 9, 10 and 11 respectively. FIG. 10 is a frontal view of putter head 5 showing shaft 3 as therein inserted. Also seen in FIGS. 3 and 5 are collinear, co-planar etched sightlines 12 and 13 respectively. FIG. 11 depicts the invention's rug component 14. Found drawn on the top surface of rug component 14 as seen in FIG. 11 are three parallel and co-planar guide lines, first side line 15, second sideline 16 and centerline 17. Lines 15, 16 and 17 begin at nearly one end of rug 14 and lines 15 and 16 end shortly therefrom whereas centerline 17 ends at nearly the other end of rug 14. FIGS. 12 and 13 highlight respectively to a greater degree than FIG. 11 the presence of lines 15, 16, 17 at one end of rug 14 and endcircle 18 at the other end of rug 14. FIGS. 14, 15 and 16 illustrate how the instant invention is utilized by a golfer in order to improve his or her putting technique. As per FIG. 14, golfer A holding shaft grip 2 as seen in FIG. 1 causes basebars 9, 10 and 11 to coincide with guidelines 15, 16 and 17 by placing putter head 5 flat upon the top surface of rug 14 behind a golf ball B. Then as per FIG. 15, putter head 5 at the base of putter component 1 is drawn back in such a manner that basebars 9, 10 and 11 remain co-incident with guidelines 15, 16 and 17 thus creating a true putting stroke along the line of the putt from a ball to endcircle 18, an artificial facsimile of a cup on a putting green. Repeated practice strokes by a golfer A utilizing the instant invention causes muscle memory to be built up in the hands, arms and body of golfer A eventually resulting in that golfer's stroking nothing but true putts down the line free from pushing or pulling of a putter outside or inside the line of the putt and free of turning of the putter during the stroke. Etched sightlines 12 and 13 enable golfer A to utilize putter component 1 on an actual golf green by way of enabling the golfer to better align a putt in preparation for performance of the stroke technique learned by way of practice at home as aforesaid utilizing the instant invention. Another feature of the instant invention worthy of note is the one whereby shaft 3 is bowed as seen in FIG. 2. Bow 19 in shaft 3 is at such an angle, to wit, 121° plus or minus one-half a degree from horizontal such that when golfer A holding putter component 1 properly sights his/her eyes down shaft 3 such that his/her line of sight is tangent to the outermost locus of points upon the surface of shaft 3 at bow 19, that line of sight will extend to the center point of center basebar 10 and at an angle of 121° plus or minus one-half a degree from horizontal. Such sighting by golfer A enables golfer A to recreate with relative exactitude the same head and body positioning whenever practicing, in furtherance of perfecting a putter stroke, is undertaken in the foregoing manner or when putter component 1 is being actually utilized on a true golf green as previously noted with reference to sightlines 12 and 13.

In closing, respectfully submitted, the instant invention, whereas clearly it facilitates a very precise means for refining a golfer's muscle memory as regards always putting down the line, is indeed truly revolutionary in the art of golf and in particular putting practice devices and is for this reason indeed new, useful and unique.

What is claimed is:

1. A training putter and rug component comprising:

a. a rectangular shaped piece of rugging greater in depth than in width;

b. three parallel guidelines commencing at nearly one end of said piece of rugging and drawn on the top surface of said piece of rugging;

c. the two lateralmost of said guide fines being each equidistant from the center one of said guidelines with said two lateralmost of said guidelines being separated from one another by a distance approximating the diameter of a regulation size golf ball;

d. the center one of said guidelines being co-extensive with the long central axis of symmetry of said piece of rugging;

e. the said center one of said guidelines terminating at a point, the locus of which is on a circle drawn at nearly a second end of said piece of rugging;

f. a putter head to which there is affixed a shaft amenable to being handheld for purposes of stroking a golf ball with said putter head;

g. said putter head being rectangularly shaped with a solid front side, a solid posterior side, a solid first lateral side and a solid second lateral side;

h. said putter head having a rectangularly shaped hollowed out center hole;

i. said putter head having three parallelwise positioned, co-planar basebars extending from the base of said first lateral side to the base of said second lateral side at the bottom of said center hole;

j. the two lateralmost of said basebars being each equidistant from the center one of said basebars with said two lateralmost of said basebars being separated from one another by a distance equal to said distance between said two lateralmost guidelines.

2. The training putter and rug of claim 1 whereby there is a rough milled face ground onto the lateral aspect of said first lateral side and an equivalent rough milled face ground onto the lateral aspect of said second lateral side.

3. A training putter and rug component:

a. a rectangular shaped piece of rugging greater in depth than in width;

b. three parallel guidelines commencing at nearly one end of said piece of rugging and drawn on the top surface of said piece of rugging;

c. the two lateralmost of said guidelines being each equidistant from the center one of said guidelines with said two lateralmost of said guidelines being separated from one another by a distance approximating a regulation size golf ball;

d. the center one of said guidelines being co-extensive with the long central axis of symmetry of said piece of rugging;

e. the said center one of said guidelines terminating at a point, the locus of which is on a circle drawn at nearly a second end of said piece of rugging;

f. a putter head to which there is affixed a shaft amenable to being handheld for purposes of stroking a golf ball with said putter head;

g. said putter head being rectangularly shaped with a solid front side, a solid posterior side, a solid first lateral side and a solid second lateral side;

h. said putter head having a rectangularly shaped hollowed out center hole;

i. said putter head having three parallelwise positioned, co-planar basebars extending from the base of said first lateral side to the base of said second lateral side at the bottom of said center hole;

j. the two lateralmost of said basebars being each equidistant from the center one of said basebars with said two lateralmost of said basebars being separated from one another by a distance equal to said distance between said two lateralmost guidelines;

k. a bow in said shaft resulting in a bend of said shaft at the locus of said bow at an angle of 121 degrees with reference to the horizontal;

l. a first etched straight line marked in the top surface of said solid first lateral side collinear with said center one of said basebars;

m. a second etched straight line marked in the top surface of said solid second lateral side collinear with said center one of said basebars.

4. The training putter and rug of claim 3 whereby there is a rough milled face ground onto the lateral aspect of said first lateral side and an equivalent rough milled face ground onto the lateral aspect of said second lateral side.

5. The training putter and rug of claim 3 whereby said angle varies between 120.5° and 121.5° with reference to the horizontal.

6. A training putter and rug comprising:

a. a rectangular shaped piece of rugging greater in depth than in width;

b. three parallel guidelines commencing at nearly one end of said piece of rugging and drawn on the top surface of said piece of rugging;

c. the two lateralmost of said guidelines being each equidistant from the center one of said guidelines with said two lateralmost of said guidelines being separated from one another by a distance approximating the diameter of a regulation size golf ball;

d. the center one of said guidelines being co-extensive with the long central axis of symmetry of said piece of rugging;

e. the said center one of said guidelines terminating at a point, the locus of which is on a circle drawn at nearly a second end of said piece of rugging;

f. a putter head to which there is affixed a shaft amenable to being handheld for purposes of stroking a golf ball with said putter head;

g. said putter head being rectangularly shaped with a solid front side, a solid posterior side, a solid first lateral side and a solid second lateral side;

h. said putter head having a rectangularly shaped hollowed out center hole;

i. said putter head having three parallelwise positioned, co-planar basebars extending from the base of said first lateral side to the base of said second lateral side at the bottom of said center hole;

j. the two lateralmost of said basebars being each equidistant from the center one of said basebars with said two lateralmost of said basebars being separated from one another by a distance equal to said distance between said two lateralmost guidelines;

k. a first etched straight line marked in the top surface of said solid first lateral side collinear with said center one of said basebars;

l. a second etched straight line marked in the top surface of said solid second lateral side collinear with said center one of said basebars.

7. The training putter and rug of claim 6 whereby there is a rough milled face ground onto the lateral aspect of said first lateral side and an equivalent rough milled face ground onto the lateral aspect of said second lateral side.

* * * * *